US009909341B2

(12) United States Patent
Thoonsen

(10) Patent No.: US 9,909,341 B2
(45) Date of Patent: Mar. 6, 2018

(54) REMOVABLE ATTACHMENT DEVICE FOR ATTACHING TO LONGER LINEAR OR FILIFORM OBJECTS

(71) Applicant: Thoonsen Trading, Chateauroux (FR)

(72) Inventor: Jacky Thoonsen, Chateauroux (FR)

(73) Assignee: THOONSEN TRADING, Chateauroux (FR)

( * ) Notice: Subject to any disclaimer, the term of this patent is extended or adjusted under 35 U.S.C. 154(b) by 0 days.

(21) Appl. No.: 14/423,553

(22) PCT Filed: Aug. 22, 2013

(86) PCT No.: PCT/FR2013/051956
§ 371 (c)(1),
(2) Date: Apr. 22, 2015

(87) PCT Pub. No.: WO2014/029949
PCT Pub. Date: Feb. 27, 2014

(65) Prior Publication Data

US 2015/0267439 A1 Sep. 24, 2015

(30) Foreign Application Priority Data

Aug. 24, 2012 (FR) ..... 12 57978

(51) Int. Cl.
*G08B 13/24* (2006.01)
*E05B 73/00* (2006.01)

(52) U.S. Cl.
CPC ..... *E05B 73/0017* (2013.01); *E05B 73/0035* (2013.01); *G08B 13/2428* (2013.01); *Y10T 70/40* (2015.04)

(58) Field of Classification Search
CPC ..... E05B 73/0017; E05B 73/0035; G08B 13/2428; Y10T 70/40
USPC ..... 340/572.1–572.9
See application file for complete search history.

(56) References Cited

U.S. PATENT DOCUMENTS 3,824,654 A * 7/1974 Takabayashi ..... A41F 1/00 24/198
4,346,869 A * 8/1982 MacNeill ..... A61M 39/284 251/10
5,140,836 A * 8/1992 Hogan ..... E05B 73/0017 292/252

(Continued)

FOREIGN PATENT DOCUMENTS

EP 0396850 A1 11/1990
EP 2169158 A1 3/2010

(Continued)

*Primary Examiner* — Brian Wilson
(74) *Attorney, Agent, or Firm* — Jacobson Holman, PLLC.

(57) ABSTRACT

A removable attachment device, that particularly forms an anti-theft device and/or electronic information medium, comprising a body on which a flap is mounted pivotably, wherein the body and the flap each have a substantially flat surface, wherein the flap rotates in relation to the body between a first extreme open position and a second extreme position known as the closed position in which the two respective surfaces can grip the object, wherein means are provided to lock the flap on the body temporarily and securely in the gripping position, characterized in that at least the gripping surface of the body and/or flap has/have raised or protruding means, that are elastically deformable.

14 Claims, 2 Drawing Sheets

(56) References Cited

U.S. PATENT DOCUMENTS

| | | | | |
|---|---|---|---|---|
| 6,279,358 | B1 | 8/2001 | Costa | |
| 7,134,302 | B2 * | 11/2006 | Gorst | E05B 73/0041 340/572.9 |
| 7,394,376 | B1 * | 7/2008 | Sayegh | E05B 73/0017 340/568.1 |
| 2006/0021394 | A1 | 2/2006 | Belden, Jr. | |
| 2008/0122633 | A1 * | 5/2008 | Tetiyevsky | G08B 13/2434 340/572.9 |
| 2010/0176951 | A1 * | 7/2010 | Zinner | E05B 73/0035 340/572.9 |

FOREIGN PATENT DOCUMENTS

| | | | |
|---|---|---|---|
| GB | 1395735 | A | 5/1975 |
| GB | 2185065 | A | 7/1987 |
| WO | 96/23123 | A1 | 8/1996 |
| WO | 03/093614 | A1 | 11/2003 |
| WO | 2007/129189 | A2 | 11/2007 |
| WO | 2008/068725 | A2 | 6/2008 |

* cited by examiner

REMOVABLE ATTACHMENT DEVICE FOR ATTACHING TO LONGER LINEAR OR FILIFORM OBJECTS

The invention relates to a removable device for attaching to an elongated or filiform object or an object with a long shape.

BACKGROUND OF THE INVENTION

Such a device may be used as an anti-theft device for items sold in stores and other points of sale, which comprises or is associated with a remote alarm triggering system.

That removable attachment device may, in another area, form a device bearing information via an electronic tag in order, for example but not exclusively, to allow the traceability of items in a manufacturing plant, where the device particularly comprises RFID technology.

The attachment device of the invention can carry out anti-theft unctions as well as the function of an electronic information medium.

The invention is more particularly described in respect of, without limitation, anti-theft devices that can be attached to objects with a longitudinal dimension that is far greater than the other two transverse dimensions by bringing two parts closer and a gripping or clamping effect. Such objects may for example include eyeglass temples, jewelry items such as necklaces, chokers, bracelets or elongated tools.

Users are looking for such anti-theft devices that are not only easily installed and removed, but also can be locked reliably on objects without allowing unintentional or prohibited removal, and additionally do so without spoiling, marking or damaging the object.

Many known anti-theft devices designed for such objects do not simultaneously fulfil all these conditions.

In particular, the reliable locking and/or holding on the object prevails over the concern for not affecting the object in any way.

For example, U.S. Pat. No. 6,279,358 describes an anti-theft device for eyeglasses, comprising a body on which a component in the shape of an upside-down U comprising a central ring in elastomer material in which one of the temples of the glasses is inserted can be fixed securely.

This known device addresses the problem of the integrity of the gripped and clamped temple very incompletely and imperfectly. That is because the temple is only gripped effectively if significant force or pressure is applied to the U-shaped element to attach it to the body. Thus, the respective actions of firstly gripping or clamping the eyeglass temple, and secondly fastening the U-shaped element on the body, are related and carried out at the same time by same said element. That is a drawback, because it is not possible to adjust or adapt the gripping force to the shape or type of the object.

Today, the pressure applied to hold the object so as to withstand the risk of longitudinal tearing from the body of the object unfortunately leads to marks or scratches on the object.

Besides, WO9623123 discloses an anti-theft device for eyeglasses comprising a body on which a flap is mounted pivotably, wherein the body and the flap each comprise a substantially flat surface and wherein the flap can rotate in relation to the body between a first extreme open position and a second extreme position known as the closed position, where the two respective surfaces can grip the object, but which does not have a surface for gripping the body and/or flap with raised or protruding means that allow elastic deformation.

The patent application WO2007129189 mentions an anti-theft device with, on the internal sides of the device, deformable material with the shape of a rectangular block where the length (larger side) extends along the longitudinal direction of the object to protect, and an electronic theft detection system (70). This known device is of the single use type.

The patent application WO2008068725 describes an anti-theft device for eyeglasses comprising a flap and a body, and two surfaces capable of gripping an object, wherein one is padded, and the use of indentations (26) made on a tab of the flap and a notch placed in a slot associated with the body, as the locking system of the device.

Further, the patent EP0396850 discloses an anti-theft device for eyeglasses comprising a body on which a flap is mounted pivotably, wherein the body and the flap each comprise a substantially flat surface and wherein the flap can rotate in relation to the body between a first extreme open position and a second extreme position known as the closed position, in which the two respective surfaces can grip the object. However, the internal rectangular gripping surfaces are elastically deformable and are flat, with no raised shapes.

BRIEF SUMMARY OF THE INVENTION

The invention is thus aimed at providing a removable attachment device, particularly an anti-theft device for objects to protect that are entirely or partly elongated or have a long shape, which device can be attached to said objects not only in a reliable manner, but also without affecting, damaging, deteriorating or marking the objects.

To that end, according to the invention, the removable attachment device that particularly forms an anti-theft device and/or electronic information tag of the type comprising a body on which a flap is mounted pivotably, wherein the body and the flap each have a substantially flat surface, and wherein the flap rotates in relation to the body between a first extreme open position and a second extreme position known as the closed position in which the two respective surfaces can grip the object, wherein means to lock said device are provided to lock the flap on the body temporarily and securely in the gripping position, is characterized in that at least the gripping surface of the body and/or flap has/have raised or protruding means that are elastically deformable.

Thus, the raised means hold the object optimally, the better to prevent removal attempts by pulling the object out of the device when it is closed, particularly with longitudinal pulling along the direction of the object and the body of the device.

Further, elastic deformation of said means on said object by applying pressure helps hold the object optimally with no risk of damaging it.

The deformable material is elastic plastic material, particularly thermoplastic elastomer (TPE) or silicone.

In particular, said means are made up of notched surfaces, and particularly have alternate parallel ribs and grooves forming waves, preferably parallel to each other.

The device has an elongated shape along a longitudinal direction and the notches and/or ribs are advantageously in a direction transversal to said longitudinal direction.

In a preferred form, the raised means are provided on the gripping surfaces on both the flap and the body.

The flap and the body each present a gripping surface that is substantially of the same length, in the longitudinal direction of the object to protect, and further, the length (longitudinal direction) is significantly greater than the transverse dimension of each surface.

Said gripping surfaces are particularly rectangular in shape.

Said protruding (raised) means:

Are either added and fixed to the body and/or flap, by gluing, welding, clipping on, molding;

Or form integral part of the body and/or flap, and are integrated into each of those when the device is made (manufactured).

Said protruding means are either discontinuous or contiguous.

The protruding means of the body and the flap respectively have complementary sides. For example, if the means are made of alternating ribs separated by grooves, said ribs of the body are placed opposite the grooves of the flap and vice versa in the gripping position.

The protruding means preferably have a section with a triangular shape, where the tip is turned towards the outside environment and makes up the gripping surface. Two tips are separated by a groove that is triangular in shape, where the angle is preferably obtuse, particularly approximately 120°.

In the extreme closed position of the flap on the body, and thus when the object is gripped, the respective gripping surfaces are parallel and separated by a distance that is slightly smaller than the corresponding dimension of the object.

In an alternative, for elongated jewelry items such as necklaces, chokers, bracelets etc. or very fine eyeglass temples (approximately a millimeter), the gripping surfaces (in the extreme closed position of the flap) are parallel and in contact or virtually in contact.

The flap is connected to the body by pivoting means of the hinge type, comprising return means of the spring type. Thus, when the device is unlocked by a tool such as a detacher, opening is automatic and very fast.

The means for holding the flap locked on the body, which are called locking means, comprise indentations made on a tab of the flap transversal to the gripping surface, and notches placed in a housing (cavity) associated with the body, wherein the indentations are designed to cooperate with the notches by locking the device in the closed position. The notches are integral with a mobile part for separating them from the indentations.

Advantageously, the indentations on the one hand and the notches on the other are tilted in the opposite direction to allow them to cooperate by engaging with each other for locking and preventing their disengagement if they are pulled in the direction opposite that of the insertion of the tab.

The indentations and notches extend in a linear manner in the direction longitudinal to the body and are successively spaced.

The many indentations and the notches make it possible to adjust the degree of closing of the flap on the body, thus adapting to the thickness of the object to grip.

The mobile piece of the locking means, housed in a closed enclosure, comprises magnetic material and is associated with a spring to make it mobile. That part is made mobile by the attraction of the magnetic material towards a powerful magnet; such a magnet constitutes a detacher for anti-theft devices in a known manner.

The body of the attachment device advantageously comprises an electronic theft-detection system of the radiofrequency or acousto-magnetic type that can trigger an alarm remotely when the device attached to an object passes close to a detector. As an alternative or in combination, the attachment device advantageously comprises an electronic tag system of the RFID type in order to read/write information relating in particular to the object said device is intended to grip.

Advantageously, the device, particularly the external surface of the body opposite the gripping surface of said body, comprises a surface for applying marking, on which an adhesive price label can be glued or any type of marking can be engraved.

Preferably, the external surfaces of the body and the flap of the device are flat.

BRIEF DESCRIPTION OF THE SEVERAL VIEWS OF THE DRAWINGS(S)

This invention will now be described with only illustrative and non-limiting examples of the scope of the invention, and from the appended illustrations, wherein.

DETAILED DESCRIPTION OF THE INVENTION

Figure 1:
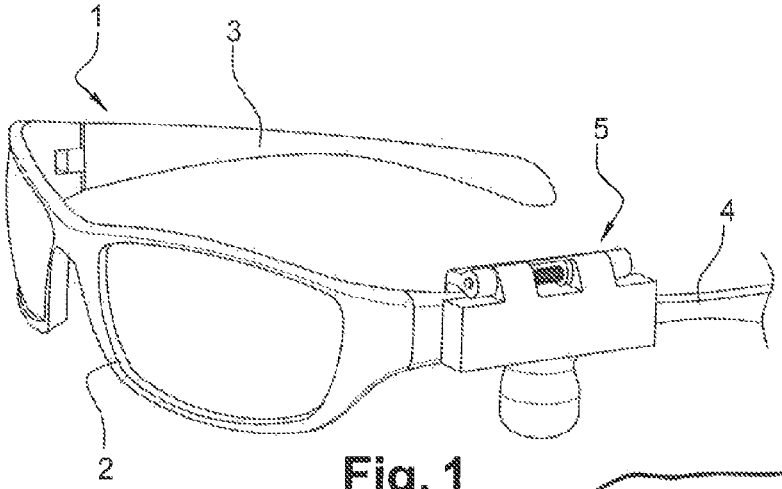
FIG. 1 is a perspective view of the device attached to an eyeglass temple.

FIG. 1 is a perspective view of a pair of eyeglasses 1 comprising a front frame 2 and two side temples 3 and 4 in the unfolded position. The removable attachment device 5 of the invention is fixed on the temple 4 with the particular function of an anti-theft device (called anti-theft device in the description below for convenience).

Figure 2:
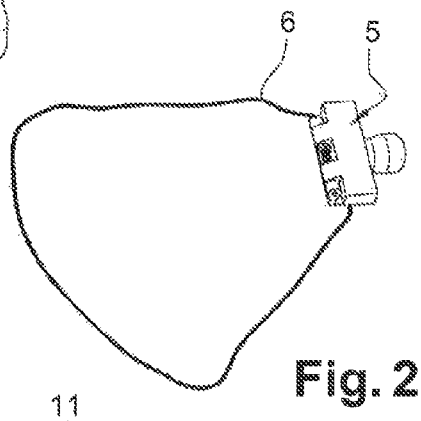
FIG. 2 is a perspective view of the device attached to a necklace or chain.

FIG. 2 is a top perspective view of a jewelry item, especially a neck chain 6 on which the anti-theft device 5 of the invention is fixed.

The device is described in greater detail in FIGS. 3A, 3B, 4A and 4B.

The anti-theft device 5 comprises two main parts, namely a body 7 and a flap 8 fitted to articulate on the body 7 along an axis 9. The body and the flap are each shaped like parallelepipeds with the larger dimension along the longitudinal direction, which is also that of the axis of rotation 9.

Further, the anti-theft device comprises an element 10 that is substantially spherical, associated with the body 7, on a longitudinal side of the body opposite the flap. Said element 10 acts as the means for grasping the anti-theft device, and further incorporates locking and electronic detection means, designed to work along with detection means and sensors placed at the exits of points of sale in which the objects associated with the anti-theft devices are displayed. The electronic detection means are known in themselves and are not shown or described.

Preferably, the element 10 that houses the detection means has a dimension transversal (height) to the longitudinal direction of the body 7 that does not exceed the height of the body and the flap in the closed position of the device. The device thus remains small, adapted to the objects to protect.

The body 7, the flap 8 and the element 10 are made of rigid plastic material, for example polyvinyl chloride (PVC).

The flap 8 rotates in relation to the body 7 along an angle of approximately 180°, between two extreme positions, namely:

- an open position (FIGS. 3A and 3B) where the flap and the body are substantially on each side of the axis 9;
- a closed or folded position (FIGS. 4A and 4B) where the flap is opposite the body and is against or very close to the body.

Figure 4A:
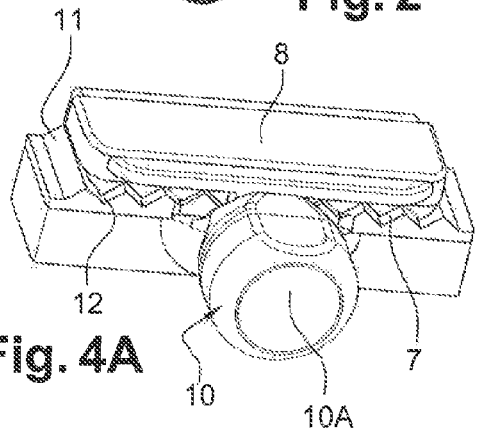
FIGS. 4A and 4B are views of the device according to the invention in the closed position, in a top perspective and a top view respectively.
Figure 4B:
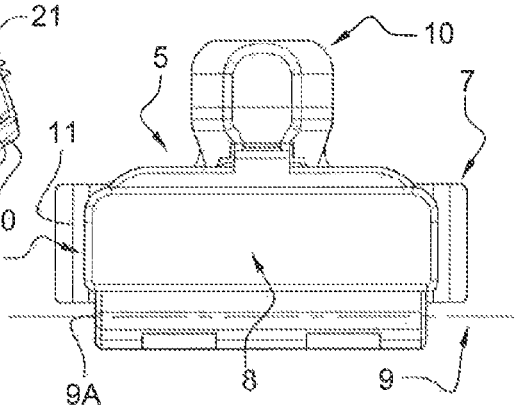

The body and the flap each comprise a rectangular side 11, respectively 12, designed to come in contact or in virtual contact or be very close to each other, in the closed position of the anti-theft device (FIGS. 4A and 4B).

The surfaces 11 and 12 have the same width (transverse direction), while the surface 11 of the body is slightly longer, on each side of the flap.

The surfaces 11 and 12 form surfaces for gripping the object, between which the object is designed to be fixed, sandwiched firmly. For example, the temple 4 (FIG. 1) of the eyeglasses and the chain 6 (FIG. 2) are thus clamped or gripped between said surfaces.

Figure 3A:
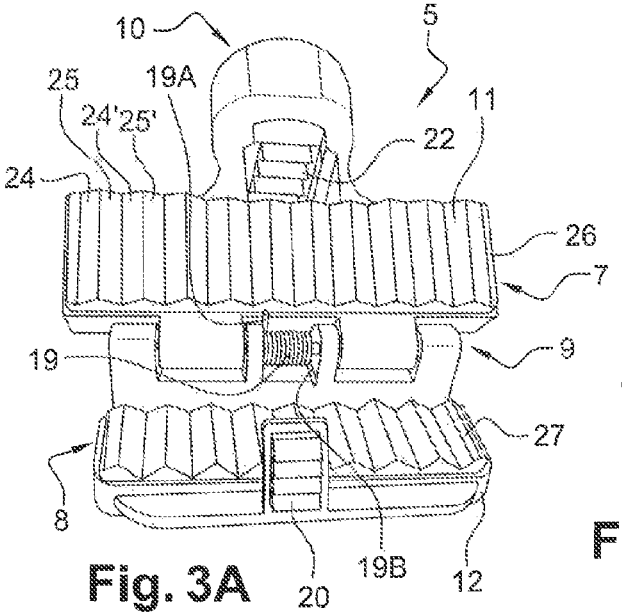
FIGS. 3A and 3B are views of the device according to the invention in the open position, respectively in a perspective top and side view.
Figure 3B:
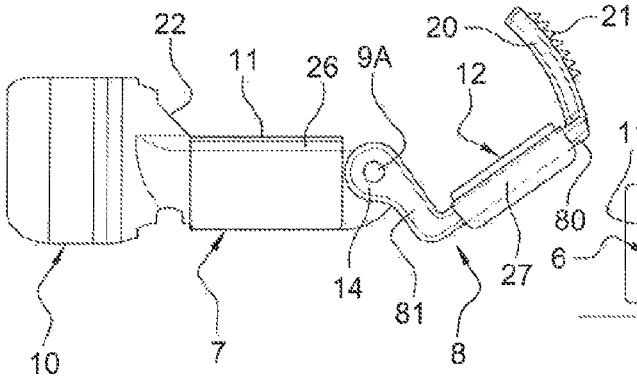

By reference to FIG. 3B, the flap 8 comprises a core 80 bearing the gripping surface 12, a wing 81 joined and orthogonal to said core 80, where the free end of the wing, opposite the gripping surface, forms part of an articulation system to make up the hinge between the flap 8 and the body 7.

Figure 5:
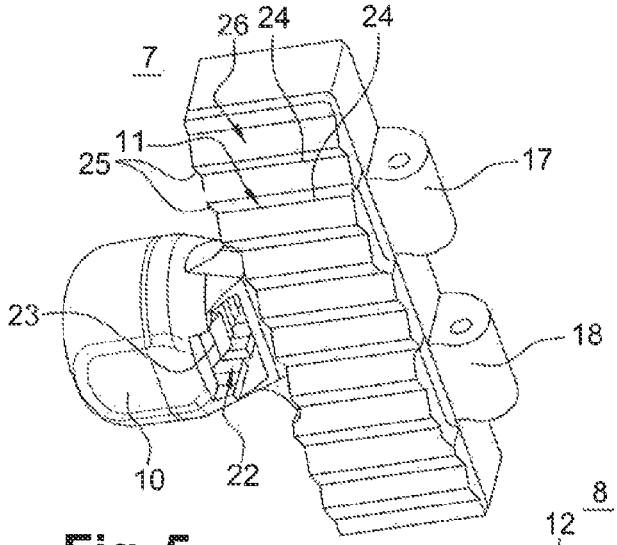
FIGS. 5 and 6 are perspective views, of the body and flap respectively, detached from each other for the sake of clarity.
Figure 6:
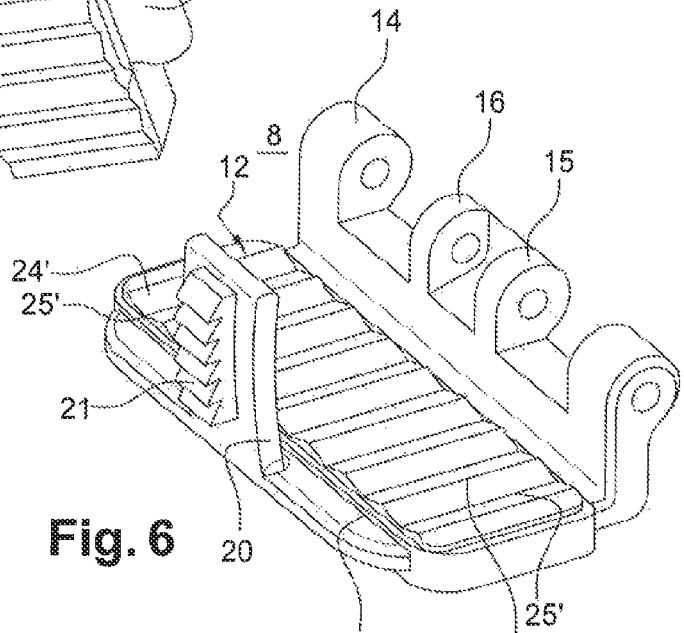

By reference to FIGS. 3A, 5 and 6, around the axis of rotation 9, the body 7 and the flap 8 comprise an articulation system made up of sleeves and tabs, which form integral part of the body and the flap, placed alternately along the axis 9. The axis takes the form of a longitudinal rod 9A, visible only in FIG. 3B.

The articulation sleeves and tabs are placed on the two respective longitudinal sides of the body and the flap, and the articulation rod 9A further goes through them.

More particularly:

- the flap comprises a first and a second end sleeve 13 and 14 and a first and a second tab 15, 16 that are central and parallel;
- the body comprises two sleeves 17, 18 located so as to fill the gap between the first end sleeve 13 and the tab 15 on the one hand, and the second end sleeve 14 and the tab 16 on the other.

A spiral spring 19 (FIG. 3A) is provided between the tabs 15 and 16, substantially at the center of the rod 9A and surrounding it, where the ends 19A and 19B are respectively supported on the body and the flap so as to create a return force that tends to open the anti-theft device to the open position (FIGS. 3A and 3B).

Locking means are provided to make the flap 8 integral with the body 7 in a temporary manner. Said means comprise (FIG. 3B, 5 and 6):

- on the flap, a tab 20 orthogonal to the gripping surface 12 of the flap, the orthogonal side of which is turned outside the flap and has parallel indentations 21;
- on the body, a housing 22 between the body 7 and the grasping element 10; said housing 22 has a shape complementary to the tab 20 and has notches 23 on its side backed by element 10;
- a non-visible locking system housed in the element 10 and comprising a retaining piece, one of the sides of which has notches 23 and a part internal to the element 10 of which is made of magnetic material. The retaining part, the working of which is known in itself, can move and is associated with a spring arranged in the element 10.

To make it easier to insert the tab 20 in the housing 22, the tab is slightly curved towards the inside of the device (FIG. 3B).

Once the tab 20 is engaged in the housing 22, the notches 23 of the housing 22 are capable of cooperating with the indentations 21 of the tab 20, wherein the indentations 21 and the notches 23 have cut corners with opposing inclinations. The notches 23 and the indentations 21 are advantageously made of plastic, such as PVC.

The magnetic material of the retaining piece housed in the element 10 makes it possible to unlock the flap 8 by separating the indented tab 20 from the notches 23. When a usual anti-theft device detachment tool (not shown) generally named a detacher and formed of a powerful magnet is applied against the element 10, particularly against the side known as the front 10A opposite the body 7 (FIG. 3), the mobile retaining piece is attracted to the detacher in the direction opposite the body 7. Its movement releases the coupling of the tab 20 with the notches 23 of the retaining piece, and under the effect of the internal spring associated with the retaining piece, the tab 20 is ejected out of the element 10, thus releasing the flap, which turns because of the return force of the spring 19 and ends in the fully open position shown in FIG. 3A.

The closing tab 20 has a dimension (width) in the longitudinal direction of the flap that is significantly smaller than the length of the flap.

The plurality of notches and indentations extending over the height of the tab (or length, dimension transverse to the longitudinal direction of the flap) makes it possible to adapt the degree of closing of the device and therefore the pressure applied to the object, thus not damaging the object.

The gripping surfaces 11 and 12 of the flap and the body respectively comprise raised or protruding means in elastically deformable material.

Said means are, in the example described, made of alternating ribs 24 for the body 7 and 24' for the flap, parallel to each other and transversal to the longitudinal direction of the body and the flap on the one hand, and grooves or furrows 25 for the body 7 and 25 for the flap that are parallel to each other and the ribs, on the other hand.

Further, said means are made up of a solid block (preferred embodiment) or individual elements in elastically deformable material, such as elastomer, or silicone for example.

The ribs and grooves form the gripping surfaces 11 and 12.

The ribs and grooves preferably have a triangular section. Two ribs are separated by a groove with an obtuse angle, particularly of about 120°.

As non-limitative examples of values:

- The height distance between the bottom of a groove from the tip or the distal end of a rib is approximately 1.5 mm;
- The height or thickness of the gripping surface in elastic plastic is approximately 3 mm;
- The distance between two distal ends of ribs is approximately 4 to 5 mm;
- The length of the gripping surface is approximately 5 cm;
- The width of the surface (direction transversal to the length in the same plane) is approximately 1 to 2 cm.

Said raised means of the gripping surfaces are preferably made of a block of material added and fastened to the body and/or flap respectively.

More particularly and as an example:

a parallelepiped block 26 is fixed to the body 7, one side of which block makes up the gripping surface 11; the block 26 is preferably fastened firmly but in a removable manner, for example by clipping on;

the flap 8 is surrounded by a parallelepiped hollow sleeve 27, one side of which makes up the gripping surface 12.

The fastening of the elastic plastic material that makes up the gripping surface or surfaces may be removable, or fully integral, for example by gluing, heat-welding or over molding.

Figure 7A:
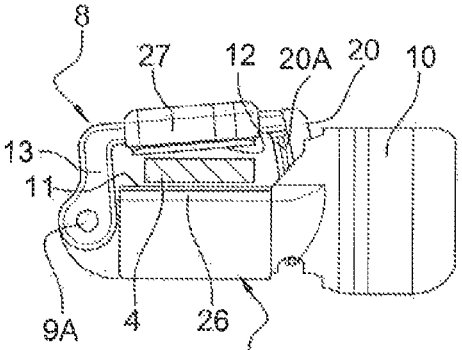
FIGS. 7A and 7B show a side view of the device in two successive closing steps to attach it to an eyeglass temple.
Figure 7B:
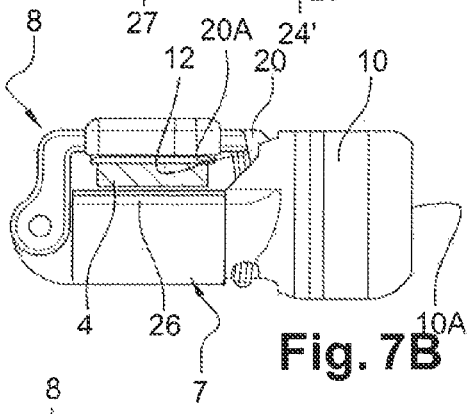

FIGS. 7A and 7B show side views of the steps of attaching the anti-theft device 1 on an eyeglass temple 4 (which temple is represented in a section for convenience).

Advantageously, the user only needs one hand to manipulate it and close it around the object, which is held in the other hand.

The user grasps the anti-theft device 1 by the grasping element 10 in one hand, particularly by placing their thumb against the front 10A of the element 10 and putting their index finger against and along the open flap 8, on the external side of the flap, opposite the gripping surface.

With their other hand, they bring the object to grip (the eyeglass temple 4) against the surface 11 of the body 7, turn the flap 8 towards the body 7 by pressing their index finger, and make the closing tab 20 enter into the complementary receiving housing 22. The notches of the housing 23 and the notches 21 of the tab 20 respectively cooperate in this position.

The arrangement obtained is shown in FIG. 7A.

The last step (FIG. 7B) consists in pressing the flap 8 by bringing it closer to the body 7, for further cooperation of the respective notches 21, 23, until the respective gripping surfaces 11 and 12 press the eyeglass temple 4.

The arrangement obtained is shown in FIG. 7B,

The elastic deformation of the raised and deformable means provided on the gripping surfaces leads to increased pressure on the eyeglass temple 4 regardless of its diameter.

Of course, a space between the two gripping surfaces 11 and 12 can be seen on each side of the object when it has a diameter or thickness of several millimeters; however, through the deformation of the protruding means, these means remain in close contact and by the pressure applied, it is impossible to remove the object through one of the ends of the anti-theft device, particularly by pulling it.

The anti-theft device is adapted for all types of diameter and thickness of the elongated object to enclose. To that end, the width of the gripping surfaces 11 and 12 is appropriate and the wing height 81 for the flap is appropriate, particularly sufficiently high.

Figure 8:
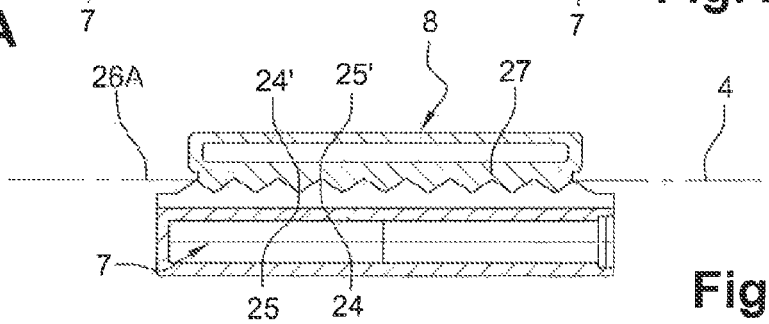
FIG. 8 shows a device in the closed position in a front view with a fine object.

For objects that are very fine, particularly approximately a millimeter or less, when the flap is closed on the body (FIG. 8), there is no space or virtually no space between the gripping surfaces 11 and 12, and the ribs 24, 24' and grooves 25, 25' are placed complementarily between the body and the flap. That alternative is more particularly intended for fine items 4 of the type jewelry items, particularly neck chains or bracelets, or fine metal eyeglass temples.

The device according to the invention can thus be attached to all types of to elongated objects, firmly and securely, with no risk of damaging the object, while offering very effective resistance to pulling that could be applied to the object longitudinally to the body of the device.

Further, associating/attaching this device does not require any tightening tool. With a single hand, the operator makes the attachment device grip the object.

The attachment device of the invention can be used as an anti-theft device and/or a device carrying information by electronic reading/writing of the type comprising an RFID electronic tab.

The invention claimed is:

1. A removable attachment anti-theft device comprising a body on which a flap is pivotably mounted on a hinge, wherein the body and the flap are elongated in a longitudinal direction and each have a substantially flat surface and a griping surface located between the hinge and an element associated with the body, the flap rotates in relation to the body between a first extreme open position and a second extreme closed position in which the two respective gripping surfaces are configured to grip an object, locking means located between the body and the element are provided to keep locked the flap on the body temporarily and securely in the closed position, wherein at least the gripping surface of the body and/or flap has/have raised or protruding means, that are elastically deformable; and wherein the device comprises detection means which are housed in the element, the element being substantially spherical and having a height according to a dimension transversal to the longitudinal direction of the body that does not exceed a height of the body and the flap in the closed position of the device.

2. The device according to claim 1, wherein the raised or protruding means are made of an elastic plastic material.

3. The device according to claim 2, wherein the elastic plastic material is thermoplastic elastomer or silicone.

4. The device according to claim 1, wherein said locking means are made up of notched surfaces with alternate parallel ribs and grooves forming waves, and being parallel to each other.

5. The device according to claim 4, wherein the grooves and ribs on the locking means are in a direction transversal to said longitudinal direction.

6. The device according to claim 1, wherein the gripping surfaces of the flap and the body are substantially the same length in the longitudinal direction to protect the object.

7. The device according to claim 1, wherein said gripping surfaces are rectangular in shape.

8. The device according to claim 1, wherein said raised or protruding means are either added and fixed to the body and/or flap, by gluing, welding, clipping on, molding, or form an integral part of the body and/or flap, and are integrated into each of the body and flap when the device is made.

9. The device according to claim 1, wherein said raised or protruding means are either discontinuous or contiguous.

10. The device according to claim 1, wherein the raised or protruding means of the body and the flap respectively have complementary sides.

11. The device according to claim 10, wherein the raised or protruding means are made of alternating ribs separated by grooves, and said ribs of the body are placed opposite the grooves of the flap and vice versa in the closed position.

12. The device according to claim 1, wherein, in the closed position of the flap on the body, the respective gripping surfaces are parallel and separated by a distance that is slightly smaller than the corresponding dimension of the object to grip, or are in contact or virtually in contact.

13. The device according to claim 1, wherein the locking means comprise indentations made on a tab of the flap transversal to the gripping surface, and notches placed in a housing associated with the body, wherein the indentations are designed to cooperate with the notches by locking the device in the closed position.

14. The device according to claim 1, wherein the detection means is detectable by an acousto-magnetic or radio frequency electronic theft-detection system.

* * * * *